US008434620B2

(12) United States Patent
Hall

(10) Patent No.: US 8,434,620 B2
(45) Date of Patent: May 7, 2013

(54) BOTTLE SHIPMENT PACKAGING AND METHOD

(75) Inventor: William E. Hall, Palatine, IL (US)

(73) Assignee: Grafcor Packaging, Inc., Rockford, IL (US)

( * ) Notice: Subject to any disclaimer, the term of this patent is extended or adjusted under 35 U.S.C. 154(b) by 0 days.

(21) Appl. No.: 13/197,384

(22) Filed: Aug. 3, 2011

(65) Prior Publication Data

US 2012/0037529 A1 Feb. 16, 2012

Related U.S. Application Data

(60) Provisional application No. 61/372,178, filed on Aug. 10, 2010.

(51) Int. Cl.
*B65D 81/127* (2006.01)

(52) U.S. Cl.
USPC ..... 206/433; 220/532; 220/552; 206/593

(58) Field of Classification Search ..... 206/433, 206/594, 593, 592, 443, 446, 436, 561, 558; 229/120.36, 120.06, 934, 89; 220/4.24, 4.21, 220/590, 510, 529, 532, 533, 552
See application file for complete search history.

(56) References Cited

U.S. PATENT DOCUMENTS

| | | | | |
|---|---|---|---|---|
| 2,050,143 | A * | 8/1936 | White | 312/140 |
| 2,189,410 | A * | 2/1940 | Stute | 229/122.33 |
| 3,038,625 | A | 6/1962 | Sinner et al. | |
| 3,039,667 | A | 6/1962 | Kozlik | |
| 3,421,679 | A | 1/1969 | Goldman | |
| 3,930,579 | A * | 1/1976 | Kurtz | 206/419 |
| 4,793,548 | A * | 12/1988 | Ross | 229/120.36 |
| 4,932,548 | A * | 6/1990 | Bensinger | 220/552 |
| 5,071,026 | A * | 12/1991 | Apps | 220/516 |
| 5,201,421 | A * | 4/1993 | Maier | 206/600 |
| 5,335,770 | A | 8/1994 | Baker et al. | |
| 5,377,862 | A * | 1/1995 | Oakes et al. | 220/513 |
| 5,427,222 | A * | 6/1995 | Miura et al. | 198/345.3 |
| 5,816,409 | A | 10/1998 | Baker et al. | |
| 6,290,057 | B1 | 9/2001 | Hurley | |
| 6,820,743 | B2 | 11/2004 | Hurley et al. | |
| 6,910,582 | B2 | 6/2005 | Lantz | |
| 7,017,746 | B2 * | 3/2006 | Apps | 206/509 |
| 7,883,001 | B2 * | 2/2011 | Goodrich | 229/122.33 |
| 2008/0184674 | A1 | 8/2008 | Hall et al. | |

* cited by examiner

*Primary Examiner* — Andrew Perreault
(74) *Attorney, Agent, or Firm* — Leydig, Voit & Mayer, Ltd.

(57) ABSTRACT

A bottle packaging for shipment includes a bottom tray, and a top tray made of molded pulp fiber, such as newspaper pulp, and a cardboard partition support structure disposed between the trays. Cavities formed in the bottom and top trays are arranged to engage both ends of a bottle and include crushable elements that can axially engage each bottle. The support partition may be made of corrugated cardboard material and be arranged such that the cardboard flutes provide support for loads imparted to the sides of the carton when the carton is laying on its side. The partition forms a void surrounding each bottle in the area of its labels. In this way, structural support and cushioning can be provided to the packaged bottles from all directions.

12 Claims, 7 Drawing Sheets

BOTTLE SHIPMENT PACKAGING AND METHOD

CROSS-REFERENCE TO RELATED APPLICATIONS

This application claims priority pursuant to Title 35 USC §119 to U.S. Provisional Application Ser. No. 61/372,178 filed Aug. 10, 2010 for "Bottle Shipment Packaging and Method" the entire content of the specification and drawings of which are hereby incorporated by reference herein as if fully set forth.

BACKGROUND OF THE INVENTION

In the shipment of glass bottles, such as wine bottles, by common carrier or courier, it has been a persistent issue that bottles will typically become damaged or break. Breakage of the bottles may occur when the carton within which the bottles are shipped is dropped or crushed during shipment. Damage to the bottles may be aesthetic, such as abrasion, rubbing, fading, or tearing of labels on the bottles, which is undesirable to the consumer receiving the shipments.

Importantly, shipping cartons and packaging must pass arduous tests before their design is accepted for transit by the carriers. One common test is administered by the International Safe Transportation Association (ISTA) and is designated as "ISTA Test Procedure 3A—Standard." A copy of the test parameters for this test is provided at the end of this document.

Various solutions have been proposed in the past that have been partially successful in alleviating some of these issues. For example, U.S. Pat. No. 6,290,057, which is entitled "Bottle Shipper," proposes use of four layers of molded pulp fiber used to ship bottles upright. The four layers of trays, which include two sets of two trays each connected at hinges, include generally cylindrical cavities when stacked onto one another such that the bottles placed in the cavities are entirely encased laterally along their lengths by the molded fiber material. Although this solution is at least partially effective in preventing breakage of the bottle, repeated shaking and crushing forces applied to the molded pulp fiber structures during shipment tend to soften and disintegrate the molded pulp fiber tray structures, especially in the area around the midsection of the outer bottles.

An additional example of a previously proposed bottle shipment packaging can be found in U.S. Pat. No. 5,816,406, which is entitled "Molded Pulp Fiber Interior Package Cushioning Structures." This solution proposes a bottle cushioning structure that cushions bottles shipped laying horizontally in the shipping carton. In one disclosed embodiment, the cushioning of the bottles is accomplished in part by providing molded shells that surround each bottle. The molded shells include internally protruding crushable projections that although are effective in substantially limiting shaking of the bottles relative to the cushioning structure during shipment, they typically also contact the bottle along its midsection thus damaging or tearing the bottle's label.

Yet another example of a previously proposed packaging for shipment of bottles is described in U.S. Pat. No. 6,910,582, which is entitled "Shock Absorbing Insulated Shipping Container Especially for Breakable Glass Bottles." This solution proposes an insulated and shock absorbing insert for a cardboard box. The insert includes a cavity in which bottles are arranged and separated by a filling structure or partition system for separating the glass bottles from one another. An additional insulated body engages and covers a top opening of the insert. As disclosed, the insulated body is formed from injection molded polyurethane. In this arrangement, a conformable material used for the top of the insert surrounds the tops of the bottles placed in the cavity of the insert. A filler structure which forms receptacles accepts the bottles and surrounds them to provide shock absorption in cooperation with the top of the insert. Although this device is effective in avoiding the breakage of bottles carried therein, it accomplishes its function by engaging the lateral surfaces of the bottles, which as described above is generally undesirable insofar as it may cause abrasion, fading or tearing of labels on the bottles.

These and other shortcomings of the prior art can be overcome as provided herein.

BRIEF SUMMARY OF THE INVENTION

The invention provides a bottle packaging for shipment that is effective in maintaining the integrity of the bottle as well as preserving the aesthetic labeling of the bottle intact during shipping. In a disclosed embodiment, twelve bottles are shipped upright in a protective packaging arrangement of components that are disposed within a shipping carton. The component arrangement includes a bottom tray, and a top tray made of molded pulp fiber, such as newspaper pulp, and a corrugated cardboard partitioned support structure disposed therebetween. The support partition may be made of corrugated cardboard material and be arranged such that the flutes extend generally horizontally when the bottles are upright.

In one aspect, the orientation of the flutes in the partition is perpendicular relative to support flutes of the shipping carton. This flute orientation in the partition provides top loading compression strength to the packaging when the packaging is lying on any one of its sides under a load applied from the top such as when other items are disposed on the packaging during a parcel delivery service transport. Cavities formed by the bottom and top trays that are arranged to engage both ends of a bottle include crushable elements that axially engage each bottle. In these ways, structural support can be provided by the carton and the packaging to the bottles from all directions.

In another aspect, the disclosure describes a method of packaging bottles for shipment over common carrier. In the disclosed method, twelve bottles may be packaged upright in a shipping carton such that engagement with the bottle by the packaging is limited to the top and bottom portions of the bottle. The packaging also enables the easy inspection of bottles prior to sealing of the packaging carton in that a bottom tray and a partition support structure enable the visual inspection of the bottles before a top tray is provided and the carton is sealed.

DETAILED DESCRIPTION OF THE INVENTION

Figure 1:
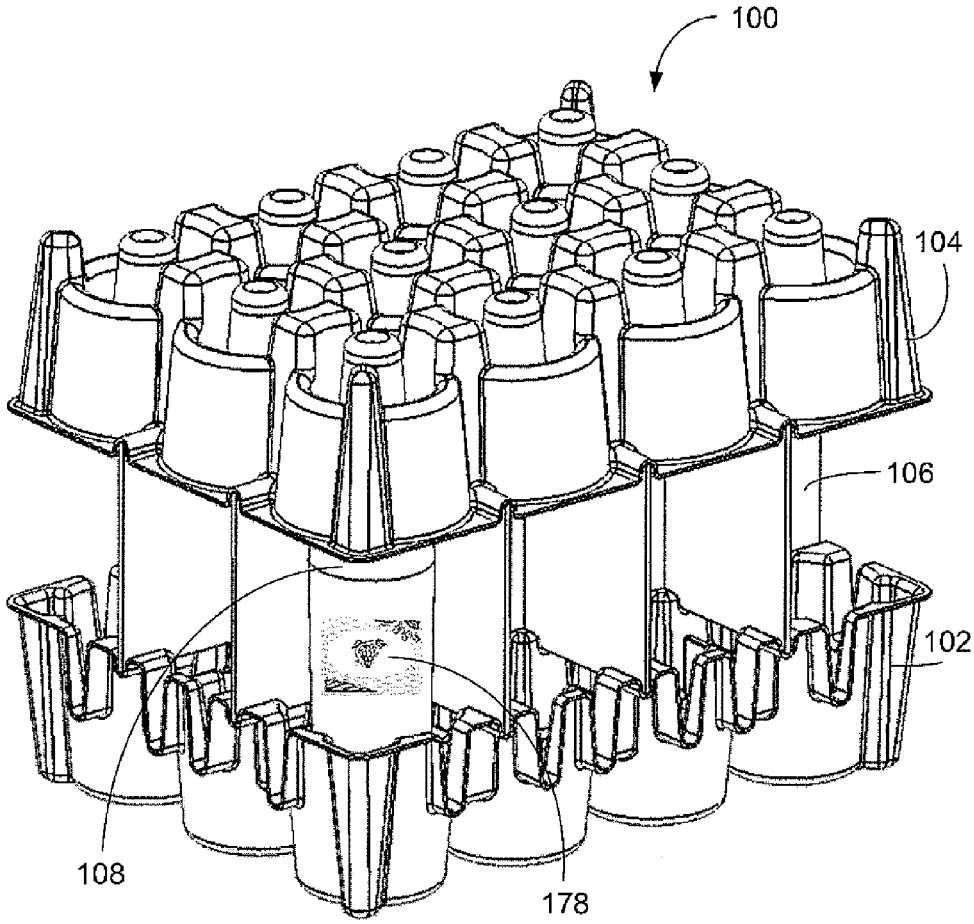
FIG. 1 is a perspective view of a shipment packaging arrangement of components in accordance with the disclosure.
Figure 2:
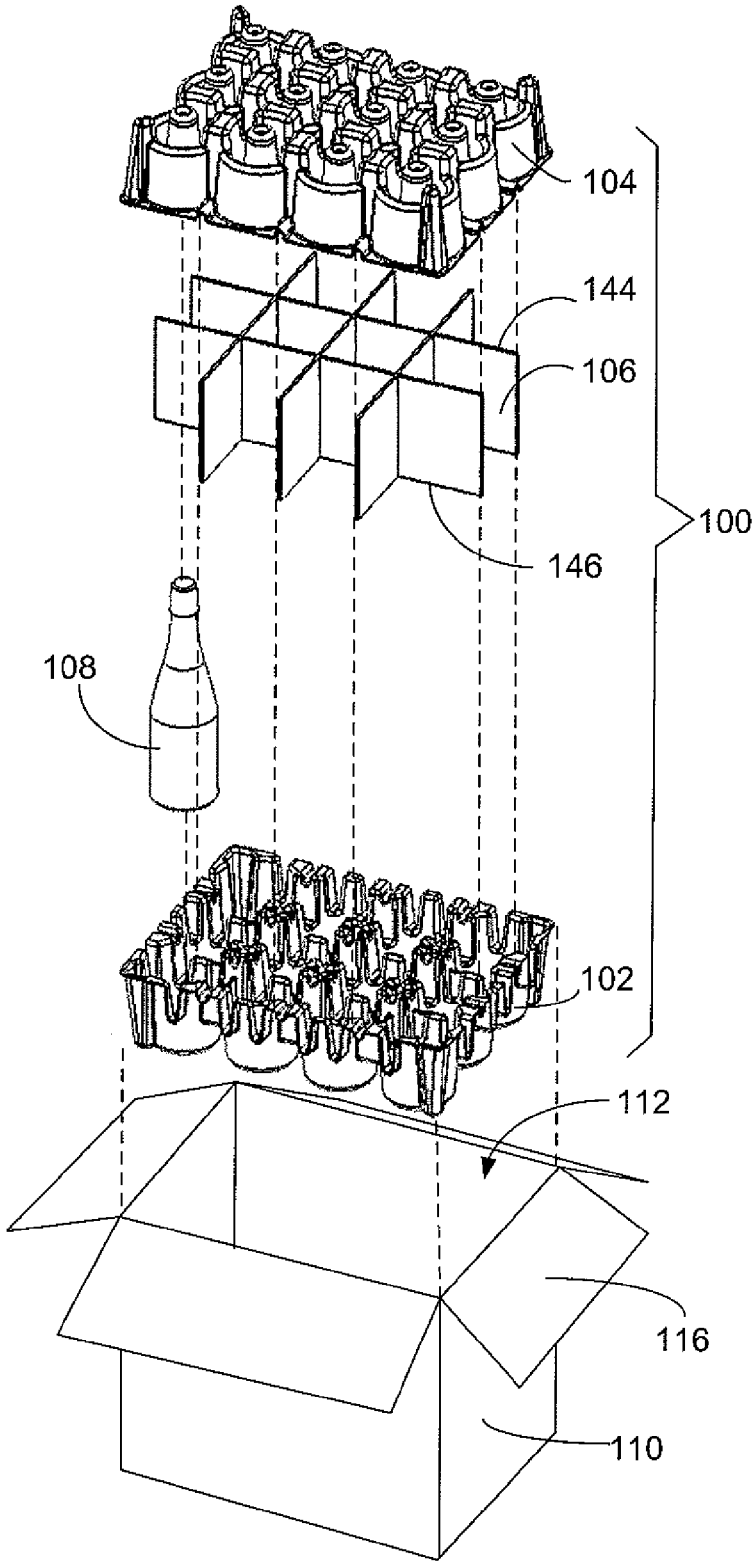
FIG. 2 is an exploded perspective view of the shipment packaging arrangement of FIG. 1, which also illustrates the shipping carton.

An outline view of a bottle shipment packaging 100 is shown removed from its shipping carton in FIG. 1, and shown in exploded view in FIG. 2. The packaging 100 includes a bottom tray 102, a top tray 104, and a support partition 106 disposed between the trays 102 and 104. The illustrated packaging is configured to hold twelve bottles that are shipped in a carton 110 (FIG. 2). The carton 110 illustrated and contemplated for shipping bottles as disclosed herein for one embodiment is a regular slotted carton (RSC) having inside dimension of 18¼" by 13⅞" by 14¼" constructed of 44 lb. edge crush test (ECT) C-flute corrugated board, but any other suitable type of carton may be used.

As shown, a bottle 108 is packaged between the bottom and top trays 102 and 104 for illustration, while other bottles are not shown for clarity. During packaging, one of the top or bottom trays 104 or 102 may be placed at the bottom of a cavity 112 of the carton 110, which is arranged to be properly dimensioned to provide a slight interference fit with the tray 102 such that the tray 102 is positively positioned and frictionally engaged with the side walls of the carton 110 to avoid displacement and rattling during shipment. As in the bottom tray 102, the edges of the top tray 104 have a slight interference fit with the side walls of the carton 110 such that the edges of the tray 104 contact the sidewalls to provide a positive positioning of the tray within the carton 110. The partition 106 is then inserted in engaging relationship to the inserted tray 102 or 104 thus creating twelve bays 114 between the members of the partition 106, each of which is configured to accept a bottle 108 as is best shown in the partially assembled view of FIG. 3 and in the assembled view of FIG. 10. When the desired number of bottles 108 have been inserted into the bays 114, the mating tray 102 or 104 is inserted over the bottles 108 to complete the packaging. In a preferred embodiment, the top tray 104 is inserted into the carton 110 first such that the bottles 108 are inserted neck down into the bays 114. In this way, insertion of the bottom tray 102 from the top over the bottoms of the bottles 108 makes for easier assembly of the packaging 100. Thereafter, the carton 110 is inverted and shipped with the bottles 108 standing upright.

Thereafter, flaps 116 of the carton 110 can be closed, secured and otherwise prepared for shipment. Unlike previously proposed packaging arrangements, the packaging 100 is advantageously configured to securely engage the bottles 108 in a fashion that resists degradation of the packaging material during transit, such as disintegration of the molded pulp fiber material of the trays that hold the bottles, while also avoiding contact with the labels that can degrade the bottles' aesthetic appearance. These attributes can be accomplished, in part, by use of securement chambers that are formed in the trays 102 and 104, as is described in further detail in the paragraphs that follow. The overall integrity of the filled container is partially accomplished by the structural configuration of the partition 106 as will also be described.

Figure 4:
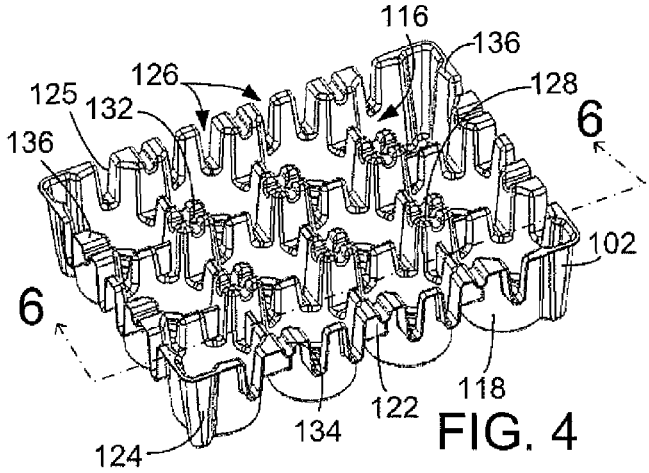
FIGS. 4 and 5 are perspective views of a bottom shipping tray in accordance with the disclosure showing respectively the interior and exterior of the tray.
Figure 5:
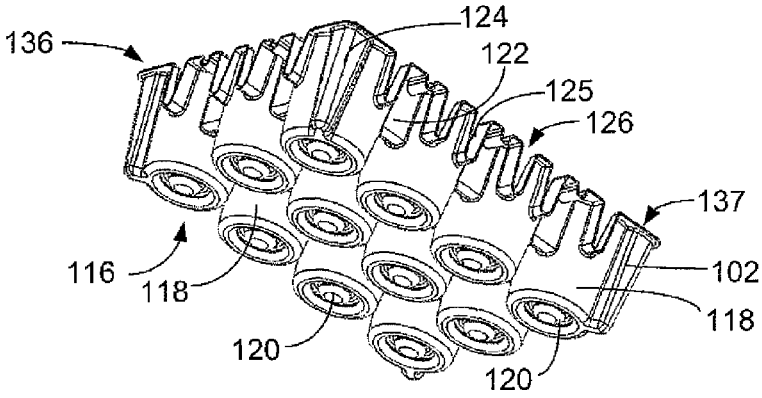
Figure 6:
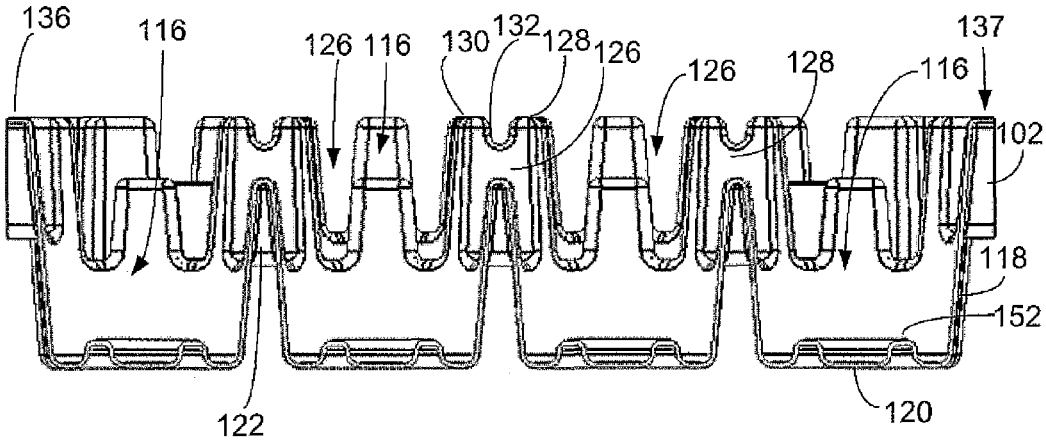
FIG. 6 is a section view of a bottom shipping tray in accordance with the disclosure.

FIGS. 4 and 5 are perspective views of the bottom tray 102 illustrating respectively the interior and exterior of the tray. The tray 102 is made of molded pump fiber. FIG. 6 is a section view to illustrated various features thereof. In the description that follows, elements and features that appear in multiples in the disclosed embodiments are designated by reference numerals in the drawings that correspond to fewer than all corresponding elements for simplicity.

Accordingly, in the illustrated embodiment the bottom tray 102 includes twelve lower securement chambers 116, which are arranged in three rows of four. Each lower securement chamber 116 has a generally cylindrical shape that forms a cup, which is defined by a hollow cylindrical wall 118 and a bottom 120 that rests upon the bottom wall of an associated carton 110 (See FIG. 10). The bottom tray 102 is formed by a paper pulp molding process, such as number 8 and/or number 10 news print pulp. The cylindrical wall 118 illustrated has a generally conical shape to facilitate the removal of the tray 102 from a mold (not shown).

A plurality of support ribs 122 are disposed, one each, between adjacent chambers 116 to provide structural support to adjacent cylindrical walls 118. The support ribs 122 provide resistance to folding or bending of the bottom tray 102 in addition to maintaining the relative orientation and spacing between adjacent securement chambers 116. Additionally, four outer posts 124 are disposed at the four outer corners of the bottom tray 102. Each post 124 provides vertical support resisting crushing of the tray 102 as well as providing a guide to ensure proper positioning of the bottom tray 102 during and after insertion into the carton 110 (FIG. 2). The bottom tray 102 additionally includes a plurality of notches 126 defined around the periphery as well as internal to the body of the bottom tray 102. Each notch 126 is positioned in a non-stress bearing area of the tray 102 and serves to reduce the overall weight of the tray 102 in addition to providing at least some flexibility for bending of the tray 102. The bending flexibility of the tray 102 aids in reducing the disintegration, cracking, and/or unraveling of the meshed fibers that make up the tray material during transit. The notches 125 have horizontally diverted sidewalls 125 that contribute to the overall strength of the tray 102.

Figure 3:
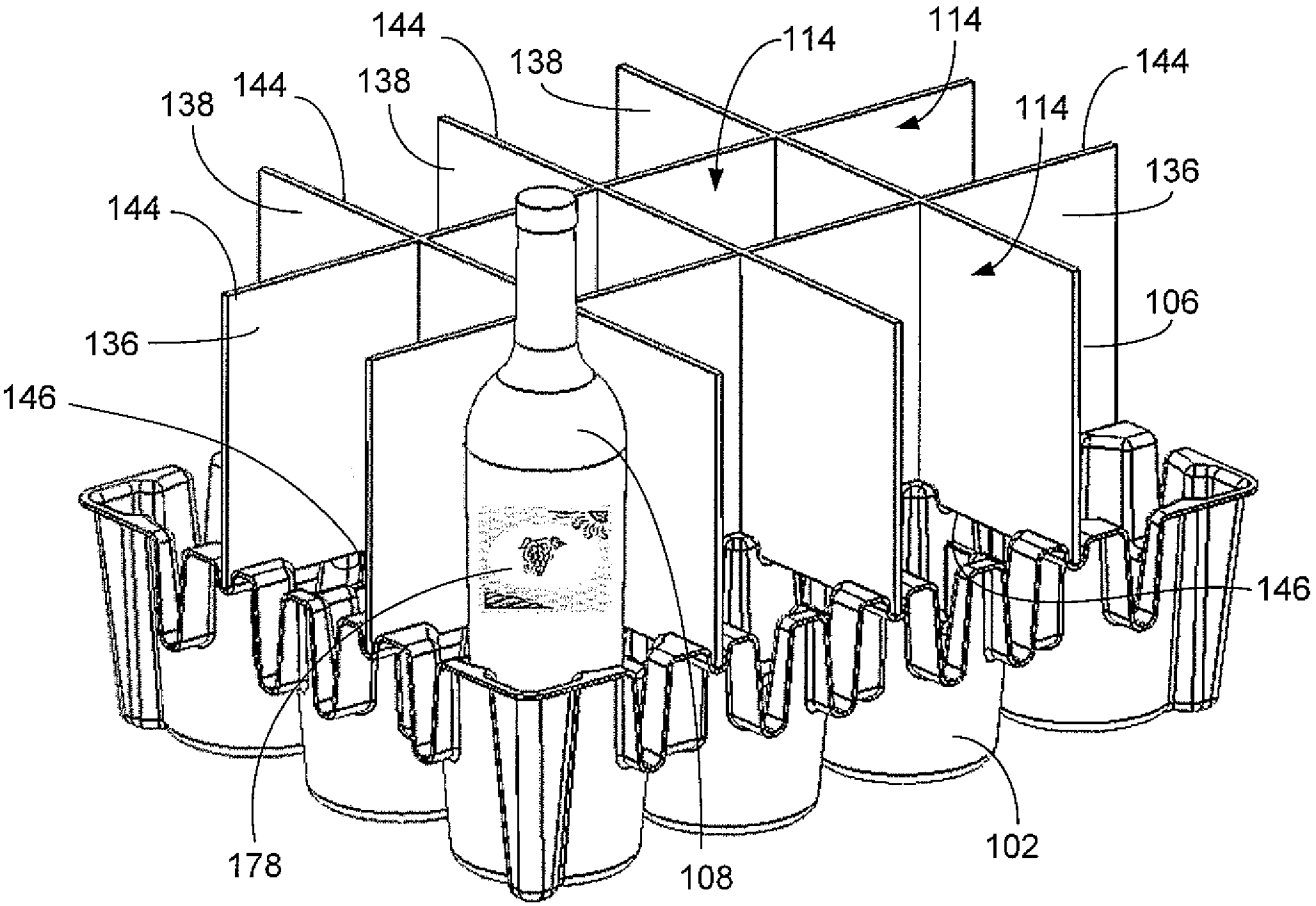
FIG. 3 is a perspective view of a partially assembled shipment packaging arrangement in accordance with the disclosure.

The bottom tray 102 further includes six posts 128 that provide support to, engage, and appropriately position the support partition 106 relative to the bottom tray 102 (FIG. 3). As shown, each post 128 includes four protrusions 130 on a top portion thereof. The four protrusions 130 are spaced apart such that a cross-shaped channel 132 is defined therebetween. Each straight segment of the cross-shaped channel 132 is aligned with a corresponding channel 134 formed along a ledge 136 of the outer peripheral wall of the bottom tray 102. In this way, the cross-shaped channels 132 and corresponding channels 134 are configured to cradle and axially constrain displacement of the partition structure 106 relative to the bottom tray 102. The ledge 136 further defines an outer peripheral edge 137 of the tray, which as previously described is configured to contact the sidewalls of the carton 110 in a slight interference fit such that the tray 102 is positively positioned within the carton 110.

More specifically, and in reference to FIGS. 3 and 11-14, the support partition 106 is made up of two long structural panels 136 and three shorter structural panels 138 that are configured to interlock with one another to form the partition 106. The interlocking relationship is accomplished by interlocking notches 140 defined in each panel 136 and 138. When assembling the partition 106, edges 142 of each panel defined at the end of each notch 140 are placed in abutting relationship with corresponding edges 142 in the mating panel while the panels 136 and 138 are perpendicular to one another and the notches 140 in the two panels are aligned. In this way, the partition 106 is made up panel by panel. When the partition 106 is assembled, the panels 136 and 138 define a top edge configuration 144 (FIG. 2) and a bottom edge configuration 146. The bottom edge configuration 146 is arranged to mate with the cross-shaped channels 132 and the corresponding channels 134 when the partition 106 is assembled onto the bottom tray 102 as previously described.

Figure 10:
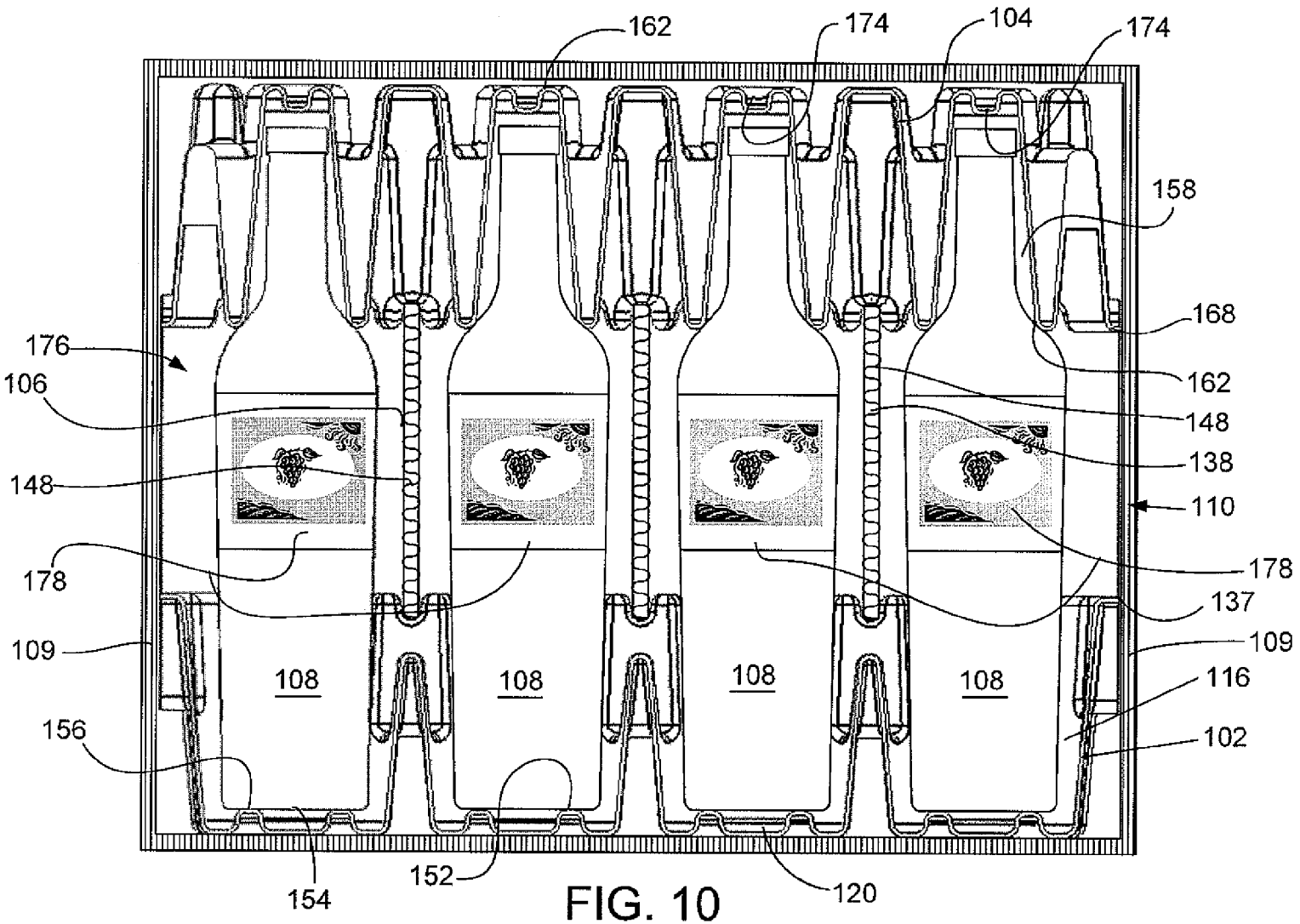
FIG. 10 is a section view of a packed shipping carton in accordance with the disclosure.
Figure 11:
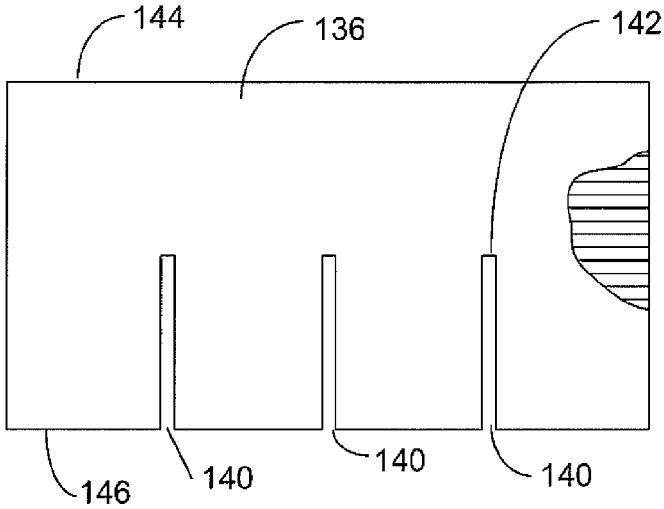
FIGS. 11 and 12 are front views of two structural elements in accordance with the disclosure.
Figure 13:
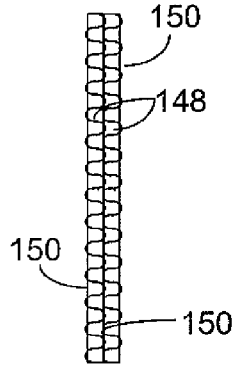
FIGS. 13 and 14 are side views of two structural elements in accordance with the disclosure.
Figure 12:
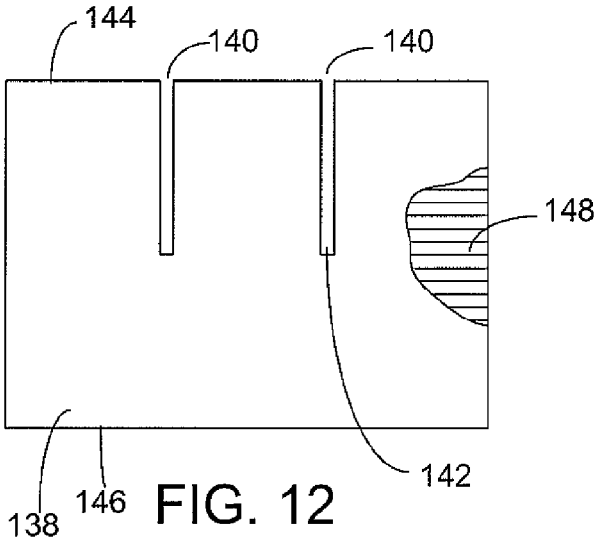
Figure 14:
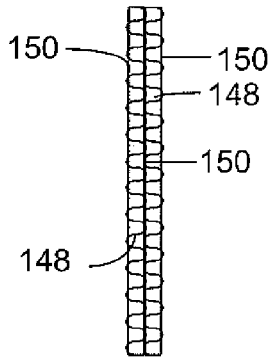
Figure 15:
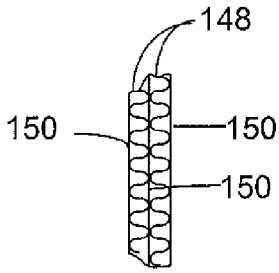
FIG. 15 is an enlarged detail side view of an alternate embodiment of a material used to construct the structural elements shown in FIGS. 13 and 14.

The panels 136 and 138 in the illustrated embodiment are made of corrugated fiberboard, which is also commonly referred to as corrugated board or corrugated cardboard. Thus, each of the panels 136 and 138 is made of a paper based material that includes a fluted corrugated medium 148 sandwiched between two flat linerboards 150. The direction of the flutes 148 extends horizontally along the length of each panel 136 and 138 thus providing the greatest structural support to the partition 106 in these directions, as shown in each of the side views presented in FIGS. 13 and 14. Such directionality of the partition 106 is combined with vertical extending flutes 109 in the corrugated board of the carton 110, as shown in FIG. 10, to provide support in the packaging 100 in all lateral directions during transit. In one embodiment, the panels 136 and 138 are made of a dual layered corrugated board, as shown in FIG. 15, which is a partial view on an enlarged scale of the cardboard structure of the panels of FIGS. 11-14. The dual layered corrugated board shown in FIG. 15 includes two layers of fluted corrugated medium 148 that is sandwiched in alternative fashion between three layers of flat linerboards 150.

Referring to FIG. 6, the bottom 120 of each lower securement chamber 116 includes a crushable ring 152 that is formed concentrically relative to the cylindrical wall 118 and that protrudes into the lower securement chamber 116. When the base portion of a bottle 108 is disposed within the lower securement chamber 116, as shown in FIG. 10, the bottom 154 of the bottle 108 rests against the ring 152, which becomes partially crushed under the weight of the bottle thus conforming to the shape of the bottom 154 and providing a cushioned, continuous engagement therewith along an annular ring contact area 156. Moreover, considering that most commonly used wine bottles have concave features formed in their bottoms, the ring 152 also serves to concentrically locate the bottle 108 relative to the cylindrical wall 118 within the lower securement chamber 116.

Figure 7:
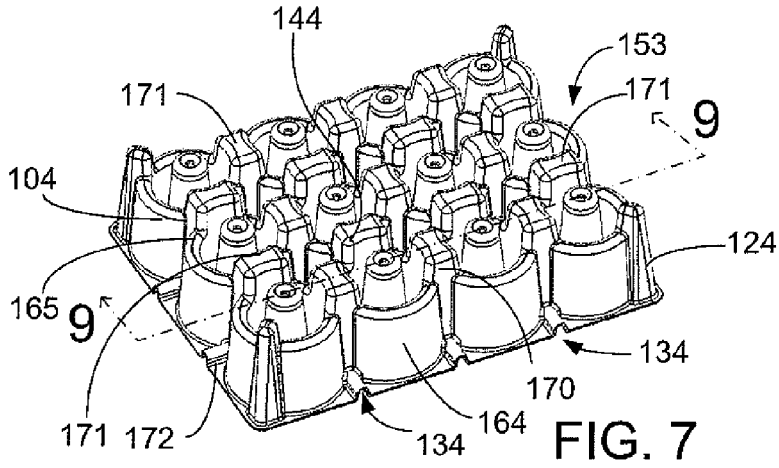
FIGS. 7 and 8 are perspective views of a top shipping tray in accordance with the disclosure showing respectively the exterior and interior of the tray.
Figure 8:
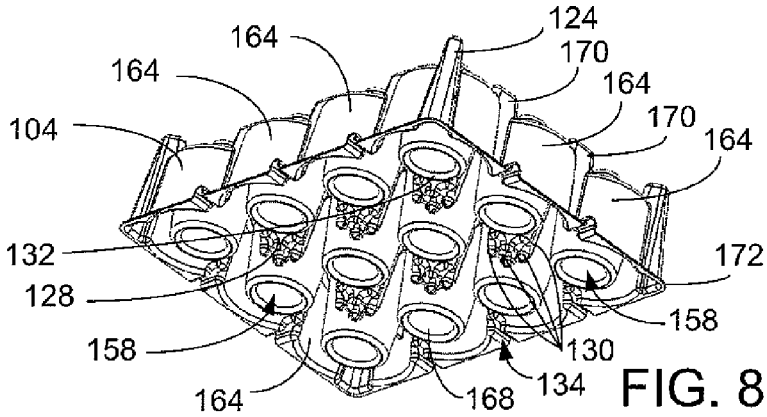
Figure 9:
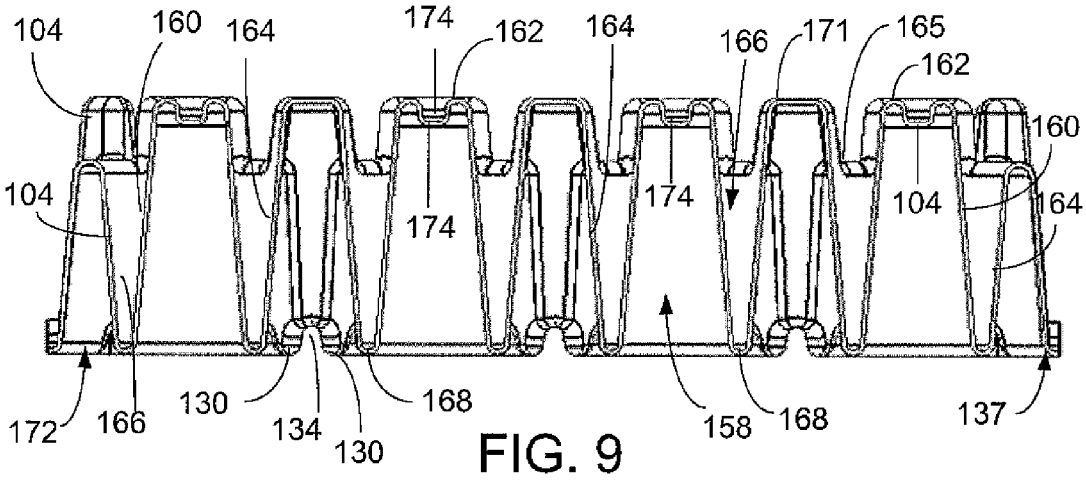
FIG. 9 is a section view of a top shipping tray in accordance with the disclosure.

Turning now to FIGS. 7, 8 and 9, top and bottom perspective views and a cross section of the top tray 104 are respectively shown. In the description that follows, structural features and elements that are the same or similar structurally or functionally as corresponding features and elements already described are denoted in the drawings and described using the same reference numerals as previously used for simplicity. Accordingly, the top tray 104 includes twelve upper securement chambers 158 that are arranged in three rows of four in corresponding arrangement with the lower securement chambers 116 (FIG. 4). Each upper securement chamber 158 has a generally cylindrical shape that forms a cup, which is defined by a hollow cylindrical wall 160 and a top 162. As in the bottom tray 102, the top tray 104 is formed by a molding process. Thus, the cylindrical wall 160 may include a draft angle along its length in the mold separation direction (in this case, downward), that is selected based on the type of material being used.

The top tray 104 is configured to engage the upper portions or necks of bottles 108 that are disposed therein (see, for example, FIG. 10). For this reason, the diameter of the upper securement chambers 158 is smaller than that of the lower securement chambers 116. To provide additional lateral protection to the cylindrical walls 160 of the upper securement chambers 158, the top tray 104 includes buttressing wall segments 164. The wall segments 164 have generally cylindrical shapes that are disposed concentrically around the cylindrical walls 160 at a distance 166. Each cylindrical wall 160 of the upper securement chambers 158 meets the inner wall portion of its corresponding wall segments 164 along a generally annular shoulder 168. As shown, each generally annular shoulder 168 is disposed concentrically around the entire lower periphery of each upper securement chamber 158.

The buttressing wall segments 164 terminate in annular rims 165. A plurality of support ribs 170 extend from annular rims 165, one each, between adjacent wall segments 164 to provide structural support. Planar support surfaces 171 are coplanar with tops 162 of each upper securement chamber 158. Ribs 170 are thus of a length to contact the top wall of the associated carton for transmissions of any load received by annular shoulders 168. The support ribs 170 provide resistance to folding or bending of the top tray 104 in addition to maintaining the relative orientation and spacing between adjacent wall segments 164 thus essentially isolating the cylindrical walls 160 of the upper securement chambers 158 from external stresses applied to the top tray 104 during shipment. Additionally, similar to the bottom tray 102, four outer posts 124 are disposed at the four outer corners of the top tray 104 to provide vertical support resisting crushing of the tray 104 as well as provide a guide to ensure proper positioning of the top tray 104 during and after insertion into the carton 110 (FIG. 2).

Similar to the bottom tray 102, the top tray 104 includes six posts 128 that provide support to, engage, and appropriately position the support partition 106 relative to the bottom tray 102 (FIG. 10). As in the bottom tray 102, each post 128 of the top tray 104 includes four protrusions 130 on a bottom portion thereof. The four protrusions 130 are spaced apart such that a cross-shaped channel 132 is defined therebetween. Each straight segment of the cross-shaped channel 132 is aligned with a corresponding channel 134 formed along a ledge 172 of the outer peripheral wall of the top tray 104. In this way, the cross-shaped channels 132 and corresponding channels 134 are configured to cradle and axially constrain displacement of the partition structure 106 relative to the top and bottom trays 102 and 104 when the two trays are aligned with one another in the carton 110 (as shown, for example, in FIG. 10).

Returning now to FIG. 9, the top 162 of each upper securement chamber 158 includes a crushable protrusion 174 that is formed concentrically relative to the cylindrical wall 160 and that protrudes into the upper securement chamber 158. When the topmost portion of a bottle 108 is disposed within the upper securement chamber 158 as shown in FIG. 10 and depending on the height of each bottle 108, the top of the bottle 108 may push against the protrusion 174. For shorter bottles, i.e. bottles that are not tall enough to reach the protrusion 174, an outer periphery of the bottle close to its top may touch and push against the annular shoulder 168. In general, the overall height of the packaging 100 may be configured to correspond to a particular bottle type and size by appropriately adjusting the dimensions of the packaging components, for example, the height of the panels 136 and 138 that made up the partition 106. In this way, contact of the bottles 108 may be insured with the top protrusion 174 and/or the shoulder 168. However, even in the case of shipments containing more than one bottle type and size, contact with at least one of the protrusion 174 and the shoulder 168 is sufficient to ensure proper cushioning and retention of the bottles 108. The relatively narrow profile of the annular shoulder 168 and/or the small profile of the protrusion 174 may be at least partially deformed or crushed when coming into contact with the bottle 108. In this way, the packaging can dynamically conform to the shape of the bottle 108. This is especially useful at those times during shipment when the packed carton 110 is subjected to crushing or vibratory loading, such that the bottles 108 are securely held and cushioned within the packaging during transit.

In reference now to FIG. 10, a plurality of bottles 108 is shown packaged within a carton 110 by use of the packaging 100 disclosed herein. As shown and previously described, each bottle 108 is retained in the carton 110 by contact of its bottom 154 with the ring 152 of the bottom tray 102 and by contact of its top with either the protrusion 174 and/or the annular shoulder 168 of the top tray 102. In such configuration, a mid-portion of the bottle 108 can remain free of contact with supporting or cushioning structures, which is especially useful for bottles having labels and so forth. As shown, for example, each bottle 108 is surrounded by a hollow cylindrical cavity 176. The cylindrical cavity 176 is devoid of any structures that may contact the bottle 108 either during packaging or shipment, and provides a buffer area to accommodate deflection of surrounding structures that, even in a deflected state, are unlikely to physically contact the bottle and cause fading or damage to the bottle or to a label 178 disposed thereon. The cylindrical cavity 176 extends axially between the bottom 120 of the lower securement chamber 116 at the bottom tray 102 and the annular shoulder 168 and/or the top 162 of the upper securement chamber 158 at the top tray 104. In a lateral or radial direction, the cavity 176 extends between the side of the carton 110 and the partition 106 for bottles disposed around the perimeter of the carton 110, or between adjacent panels 136 and 138 (see, for example, FIG. 3) for bottles disposed internally in the carton 110.

The packaging 100 described and shown herein is advantageously capable of passing the ISTA 3A testing procedure. As can be seen from the testing procedure parameters listed at the end of this document, the ISTA 3A test includes various drop, shock and vibration test sequences performed along multiple axes of the carton. It is believed that the cross directionality of the flutes in the walls of the carton and the partition 106 (FIG. 10), as well as the cushioning and retention of the bottles by the top and bottom trays 104 and 102 provide sufficient securement of the bottles and structural integrity to the bottle to withstand this arduous test procedure. All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An article packaging arrangement for shipping a plurality of packaged articles within a shipping carton comprising:

a molded pulp fiber bottom tray defining a plurality of lower securement chambers, a molded pulp fiber top tray defining a plurality of upper securement chambers, a support partition of intersecting panels disposed between said top tray, and said bottom tray forming a plurality of article receiving bays aligned with said securement chambers of said bottom tray and said top tray, said support partition having a plurality of first parallel panels extending in a first direction, having bottom edges supported by said bottom tray and top edges supporting said top tray, a plurality of second parallel panels intersecting said first panels having bottom edges supported by said bottom tray and top edges supporting said top tray;

wherein said bottom tray and said top tray each include hollow walls defining said securement chambers, said trays including posts disposed between adjacent hollow walls supporting said support partition;

wherein said posts include protrusions defining a cross-shaped channel of straight segments, with said panels of said support partition cradled within said straight segments of said cross-shaped channels;

wherein said hollow walls defining said securement chambers of said top tray and bottom tray are generally cylindrical and said lower securement chambers each include a bottom defining a crushable ring formed concentrically relative to said hollow generally cylindrical walls that protrudes into said lower securement chamber.

2. An article packaging arrangement as claimed in claim 1 wherein said bottom tray and top tray each include an outer peripheral wall defining a ledge surrounding said hollow walls defining said securement chambers, said ledges defining channels aligned with said straight segments of said cross-shaped channels supporting said support partition.

3. An article packaging arrangement as claimed in claim 2 wherein said upper securement chambers of said top tray each include a top, defining a crushable protrusion formed concentrically to said hollow generally cylindrical walls that protrudes into said upper securement chamber.

4. An article packaging arrangement as claimed in claim 3 wherein said top tray includes a buttressing wall segment disposed concentrically around each said hollow generally cylindrical wall defining said securement chambers that meets said hollow generally cylindrical walls along a generally annular shoulder that forms the lower periphery of each said upper securement chamber.

5. An article packaging arrangement as claimed in claim 4 wherein said top tray includes a plurality of support ribs between adjacent buttressing wall segments and said bottom tray includes a plurality of support ribs between adjacent hollow walls defining said securement chambers thereof.

6. An article packaging arrangement as claimed in claim 5 wherein said outer peripheral wall of said top tray and said outer peripheral wall of said bottom tray defining said ledges each include a perimeter edge sized to have a slight interference fit with the side walls of an associated carton.

7. An article packaging arrangement as claimed in claim 6 wherein said top tray and said bottom tray each includes corner posts extending from said ledge thereof.

8. An article packaging arrangement as claimed in claim 7 wherein said bottom tray includes a plurality of notches defined around its periphery and internal to the bottom tray in non-stress bearing areas.

9. A method of packaging a plurality of articles in a carton comprising:

providing a carton having a top and bottom and side walls with access into the carton through at least one of said top and bottom walls, providing an article packaging arrangement comprising:

a molded pulp fiber bottom tray defining a plurality of lower securement chambers, a molded pulp fiber top tray defining a plurality of upper securement chambers, a support partition of intersecting panels disposed between said top tray, and said bottom tray forming a plurality of article receiving bays arranged to be aligned with said securement chambers of said bottom tray and said top tray, said support partition having a plurality of first parallel panels extending in a first direction, having bottom edges supported by said bottom tray and top edges supporting said top tray, a plurality of second parallel panels intersecting said first panels having bottom edges to be supported by said bottom tray and top edges supporting said top tray, wherein said bottom tray and said top tray each include hollow walls defining said securement chambers, said trays including posts disposed between adjacent hollow walls supporting said support partition;

wherein said posts include protrusions defining a cross-shaped channel of straight segments, with said panels of said support partition cradled within said straight segments of said cross-shaped channels;

wherein said hollow walls defining said securement chambers of said top tray and bottom tray are generally cylindrical and said lower securement chambers each include a bottom defining a crushable ring formed concentrically relative to said hollow generally cylindrical walls that protrudes into said lower securement chamber;

the steps comprising:

inserting one of said top tray and bottom tray into said carton, inserting said support partition into said carton to overlie one of said top tray and bottom tray, inserting a plurality of articles into said bays, inserting the other of said top tray and bottom tray into said carton to overlie said support panel, closing said access.

10. A method as described in claim 9 wherein said access into said carton is at said bottom wall thereof and wherein said top tray is first inserted into said carton, and said bottom tray is inserted into said carton after insertion of said support partition and said articles.

11. A method as claimed in claim 9 wherein said articles are bottles.

12. A method as claimed in claim 9 wherein said carton is corrugated cardboard with the flutes of said side walls disposed vertically and said support panels of said partition are formed of corrugated cardboard having flutes perpendicular to the flutes of said side walls of said carton.

* * * * *